US009835096B2

(12) United States Patent
Vosz et al.

(10) Patent No.: US 9,835,096 B2
(45) Date of Patent: Dec. 5, 2017

(54) APPARATUS AND METHODS FOR PERFORMING VARIABLE DISPLACEMENT CONTROL FOR A VEHICULAR ENGINE

(71) Applicant: Honda Motor Co., Ltd., Tokyo (JP)

(72) Inventors: Adam Vosz, Delaware, OH (US); Kiyonari Matsuda, Dublin, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 181 days.

(21) Appl. No.: 14/470,676

(22) Filed: Aug. 27, 2014

(65) Prior Publication Data

US 2016/0061119 A1 Mar. 3, 2016

(51) Int. Cl.
*F02D 17/02* (2006.01)
*F02D 41/00* (2006.01)

(52) U.S. Cl.
CPC ..... *F02D 17/02* (2013.01); *F02D 41/0087* (2013.01)

(58) Field of Classification Search
CPC ..... F02D 17/02; F02D 41/0087
USPC ..... 123/481, 445, 198 F, 350, 406.2, 673; 701/102–105, 112
See application file for complete search history.

(56) References Cited

U.S. PATENT DOCUMENTS 5,477,827 A * 12/1995 Weisman, II ..... B60K 31/04 123/436
5,899,189 A * 5/1999 Adelsperger ..... F02D 17/02 123/436
6,532,926 B1 3/2003 Kuroda et al.
6,668,546 B2 12/2003 Hayman et al.
6,691,669 B2 2/2004 Surnilla et al.
6,715,462 B2 4/2004 Bidner et al.
6,922,986 B2 8/2005 Rozario
7,028,661 B1 4/2006 Bonne et al.
7,047,932 B2 5/2006 Surnilla et al.
7,204,235 B1 4/2007 Gebby et al.
7,363,915 B2 4/2008 Surnilla et al.
7,890,243 B2 2/2011 Abendroth
8,108,132 B2 1/2012 Reinke
8,215,283 B2 7/2012 Warchuck
8,473,179 B2 * 6/2013 Whitney ..... F02D 13/0207 701/102
8,548,715 B2 10/2013 Gallagher et al.
(Continued)

FOREIGN PATENT DOCUMENTS

WO WO2008/071670 A1 6/2008

*Primary Examiner* — Joseph Dallo
(74) *Attorney, Agent, or Firm* — Kenealy Vaidya LLP

(57) ABSTRACT

Some embodiments are directed to a variable displacement controller for use with a vehicular engine. The controller can receive data indicative of ambient temperature and data indicative of at least one of engine speed and vehicle speed. The controller can determine engine torque value based on the engine speed, and determine a torque limit based on the ambient temperature and at least one of the determined engine torque value and the data indicative of vehicle speed. The controller can compare the engine torque value to the torque limit, and selectively activate/deactivate an engine cylinder based on the comparison between the engine torque value and the torque limit, such that the engine cylinder is deactivated if the engine torque value is less than the torque limit, and the engine cylinder is activated if the engine torque value is greater than or equal to the torque limit.

20 Claims, 7 Drawing Sheets

(56) References Cited

U.S. PATENT DOCUMENTS

| | | | | |
|---|---|---|---|---|
| 8,620,561 | B2 | 12/2013 | Murakami et al. | |
| 2009/0012694 | A1* | 1/2009 | Darr | F01N 3/021 701/102 |
| 2010/0070120 | A1* | 3/2010 | Bailey | B60K 6/46 701/22 |
| 2011/0088661 | A1 | 4/2011 | Sczomak et al. | |
| 2011/0191010 | A1* | 8/2011 | Russ | F02M 26/00 701/108 |
| 2012/0029787 | A1* | 2/2012 | Whitney | F02D 13/0207 701/102 |
| 2013/0291830 | A1* | 11/2013 | Doering | F02D 41/023 123/350 |
| 2013/0297187 | A1* | 11/2013 | Doering | F02D 41/022 701/104 |
| 2013/0297191 | A1* | 11/2013 | Gibson | F02N 11/0855 701/112 |
| 2014/0200794 | A1* | 7/2014 | Gibson | G06N 99/005 701/103 |
| 2014/0245993 | A1* | 9/2014 | Weber | F02D 13/06 123/349 |
| 2014/0257674 | A1* | 9/2014 | Assaf | F02D 41/0027 701/104 |
| 2014/0261315 | A1* | 9/2014 | Willard | F02D 17/02 123/349 |

* cited by examiner

| Ne \ WOT | 1% | 2% → | | 100% |
|---|---|---|---|---|
| 800 | 10 | 20 | | |
| 850 | 25 | 40 | | |
| ↓ | | | | |
| redline | | | | 140 |

APPARATUS AND METHODS FOR PERFORMING VARIABLE DISPLACEMENT CONTROL FOR A VEHICULAR ENGINE

BACKGROUND

The disclosed subject matter relates to methods and apparatus for controlling a variable-displacement, multiple-cylinder, internal combustion engine. More particularly, the disclosed subject matter relates to varying the displacement by selectively deactivating combustion in one or more cylinders of the engine.

Some related art internal combustion engines can include a relatively large number of combustion cylinder assemblies in order to achieve one or more desirable performance targets, such as but not limited to high travel speed, low acceleration times, high torque output at low speeds, etc. Generally, fuel efficiency of an engine with a larger number of combustions cylinders can be less than that for an engine having a smaller number of combustion cylinder assemblies. Additionally, the total torque output by the engine can exceed the amount necessary under certain operating conditions, such as idling, low speed travel, heavy traffic, etc. This excess torque can be converted to heat exhausted to the ambient environment, thus further reducing the fuel efficiency of the engine.

In order to enhance or improve fuel efficiency under low load conditions, some related art multiple-cylinder engines can selectively deactivate combustion in one or more cylinders of the engine. For example, a six-cylinder engine can be operated in a four-cylinder mode or in a three-cylinder mode. Similarly, an eight-cylinder engine can be operated in one of at least six-a cylinder mode and a four-cylinder mode.

SUMMARY

However, noise and/or vibration characteristics differ depending on the mode in which the engine is operating. For example, noise and/or vibration characteristics differ depending on whether a six-cylinder engine is operating in the six-cylinder mode, a four-cylinder mode, or a three-cylinder mode. In other words, the noise and/or vibration characteristics of each of these modes can be different than the other modes. These different noise and vibration characteristics can be transmitted into the passenger compartment of the vehicle where they can be perceived by one or more passenger(s) as undesirable.

A system (and in some cases a complicated system) of engine damper mounts or damper mounting systems can be used to isolate the passenger compartment from these undesirable noise and vibration characteristics, or at least reduce the impact of these noise and vibration characteristics on the passenger(s). These damper mounting systems can increase the cost and complexity for assembly, can increase maintenance costs, and can increase the overall weight of the vehicle thereby reducing the fuel efficiency for the vehicle.

It may therefore be beneficial to provide a variable-displacement, multiple-cylinder, internal combustion engine that addresses at least one of the above and/or other disadvantages of the related art. In particular, it may be beneficial to methods and apparatus for selectively activating and deactivating one or more combustion cylinder assemblies based on the current ambient conditions. For example, it may be beneficial to selectively activate and deactivate combustion in one or more cylinders based on ambient temperature data.

Some embodiments are therefore directed to a variable displacement controller for use with a vehicular engine that includes multiple cylinder assemblies. The controller can include a processor that receives data indicative of ambient temperature and data indicative of at least one of engine speed and vehicle speed. The processor can determine an engine torque value based on the received data indicative of engine speed, and determine a torque limit based on the ambient temperature and at least one of the determined engine torque value and the data indicative of vehicle speed. The processor can also compare the determined engine torque value to the determined torque limit, and selectively activate/deactivate at least one of the engine cylinder assemblies based on the comparison between the engine torque value and the torque limit, such that the at least one of the engine cylinder assemblies is deactivated if the engine torque value is less than the torque limit, and the at least one of the engine cylinder assemblies is activated if the engine torque value is greater than or equal to the torque limit.

Some other embodiments are directed to a variable displacement system that can include a vehicle engine including multiple cylinder assemblies, a temperature sensor that obtains data indicative of ambient temperature, and a speed sensor that obtains data indicative of at least one of engine speed and vehicle speed. The variable displacement system can also include a controller having a processor that receives data indicative of ambient temperature and data indicative of at least one of engine speed and vehicle speed. The processor can determine engine torque value based on the received data indicative of engine speed, and determine a torque limit based on the ambient temperature and at least one of the determined engine torque value and the data indicative of vehicle speed. The processor can also compare the determined engine torque value to the determined torque limit, and selectively activate/deactivate at least one of the engine cylinder assemblies based on the comparison between the engine torque value and the torque limit, such that the at least one of the engine cylinder assemblies is deactivated if the engine torque value is less than the torque limit, and the at least one of the engine cylinder assemblies is activated if the engine torque value is greater than or equal to the torque limit.

Still other embodiments are directed to a method of performing variable displacement for a vehicular engine that includes multiple cylinder assemblies. The method can include: receiving data indicative of ambient temperature; receiving data indicative of at least one of engine speed and vehicle speed; determining actual engine torque based on the received data indicative of engine speed; determining a torque limit based on the ambient temperature and at least one of the determined engine torque value and the data indicative of vehicle speed; comparing the determined engine torque value to the determined torque limit; and selectively activating/deactivating at least one of the engine cylinder assemblies based on the comparison between the engine torque value and the torque limit, such that the at least one of the engine cylinder assemblies is deactivated if the engine torque value is less than the torque limit, and the at least one of the engine cylinder assemblies is activated if the engine torque value is greater than or equal to the torque limit.

BRIEF DESCRIPTION OF THE DRAWINGS

The disclosed subject matter of the present application will now be described in more detail with reference to exemplary embodiments of the apparatus and method, given by way of example, and with reference to the accompanying drawings, in which.

DETAILED DESCRIPTION OF EXEMPLARY EMBODIMENTS

A few inventive aspects of the disclosed embodiments are explained in detail below with reference to the various figures. Exemplary embodiments are described to illustrate the disclosed subject matter, not to limit its scope, which is defined by the claims. Those of ordinary skill in the art will recognize a number of equivalent variations of the various features provided in the description that follows.

I. Exemplary Vehicle and Engine Assemblies

Figure 1:
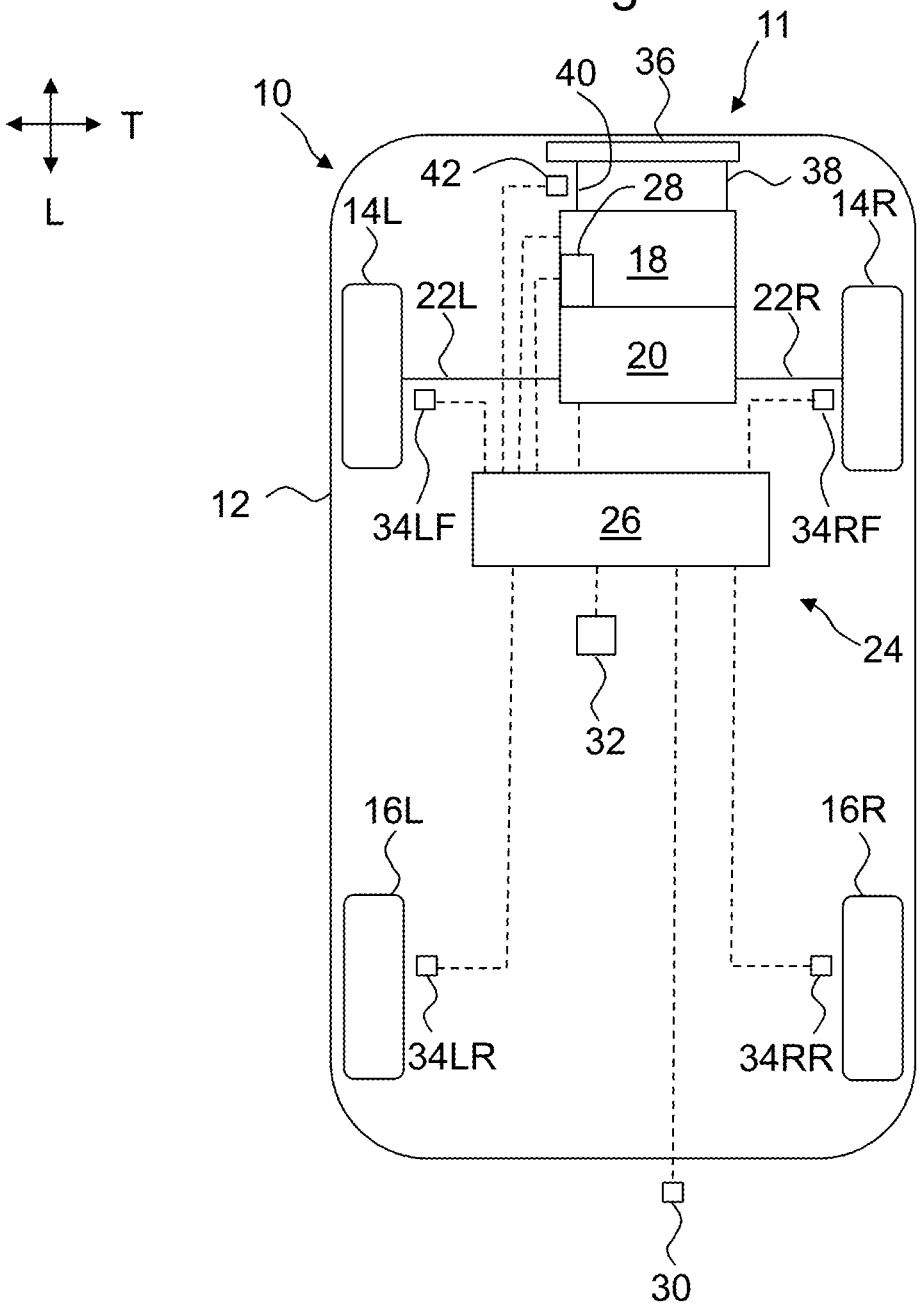
FIG. 1 is a schematic view of a powertrain for a vehicle in accordance with the disclosed subject matter.

FIG. 1 illustrates an embodiment of a vehicle 10 made in accordance with the principles of the disclosed subject matter. The vehicle 10 can include a powertrain 11, a body 12, a pair of front wheels 14L, 14R and a pair of rear wheels 16L, 16R. The powertrain 11 can be configured to drive at least one of the pair of front wheels 14L, 14R and the pair of rear wheels 16L, 16R. The body 12 can enclose a passenger compartment configured to accommodate at least one passenger.

The powertrain 11 can include an internal combustion engine 18, a transmission 20, a pair of driveshafts 22L, 22R, a control system 24 and an engine cooling system.

The output axis of the engine 18 can be oriented in the longitudinal direction L or in the traverse direction T of the vehicle 10. The engine 18 can be mounted forward of the front axles, rearward of the rear axles, or intermediate the front and rear axles. The engine 18 can be connected to drive the front wheels 14L, 14R, or the rear wheels 16R, 16L, or both the front wheels 14L, 14R and the rear wheels 16L, 16R. In the exemplary embodiment of FIG. 1, the engine 18 is configured as a transversely-oriented front-mounted internal combustion engine driving the front wheels 14L, 14R.

The engine 18 can include a plurality of combustion cylinder assemblies of an even count or of an odd count. The cylinders can be arranged in "V" pattern or a "W" pattern, arranged in pair of horizontally opposed banks, arranged in a single row, or arranged in any other appropriate configuration.

The transmission 20 can be configured as an automatic transmission, a manual transmission, or a semi-automatic transmission. The transmission 20 can be configured in any appropriate manner with a stepped speed ratio assembly or a continuously variable speed ratio assembly. The transmission 20 can be coupled to the driveshafts 22L, 22R in any appropriate manner that can permit transmission drive torque from the engine to the front wheels.

A coupling can connect the engine output shaft to the transmission input shaft. The coupling can permit selective engagement/disengagement of the input shaft with the engine output shaft, or at least permit relative rotation of the engine output shaft with respect to the input shaft, in any appropriate manner. Exemplary couplings can include, but are not limited to, a friction disc clutch and a torque converter. The exemplary vehicle 10 of FIG. 1 can include a torque converter and a lock-up clutch that can selectively connect the input and output of the torque converter to rotate together.

In order to enhance or improve the fuel efficiency of the engine 18 during certain operating conditions, the control system 24 can be configured to selectively deactivate and activate at least one of the combustion cylinder assemblies. The control system 24 can include a controller 26 and a cylinder deactivation assembly 28. The controller 26 can be in electrical communication with the engine 18, the transmission 20, the cylinder deactivation assembly 28, an air temperature sensor 30, a timer 32, and wheel speed sensors 34LF, 34RF, 34LR, 34RR in any appropriate manner. The control system 24 can share the sensors 30, 34LF, 34RF, 34LR, 34RR and the timer 32 with other system(s) of the vehicle 10. In the exemplary embodiment of FIG. 1, the air temperature sensor 30 also can share data with a heating, ventilation and cooling system of the vehicle 10. However, exemplary embodiments are intended to include the one or more of the timer 32 and the sensors 30, 34LF, 34RF, 34LR, 34RR as exclusive to the control system 24.

Figure 2:
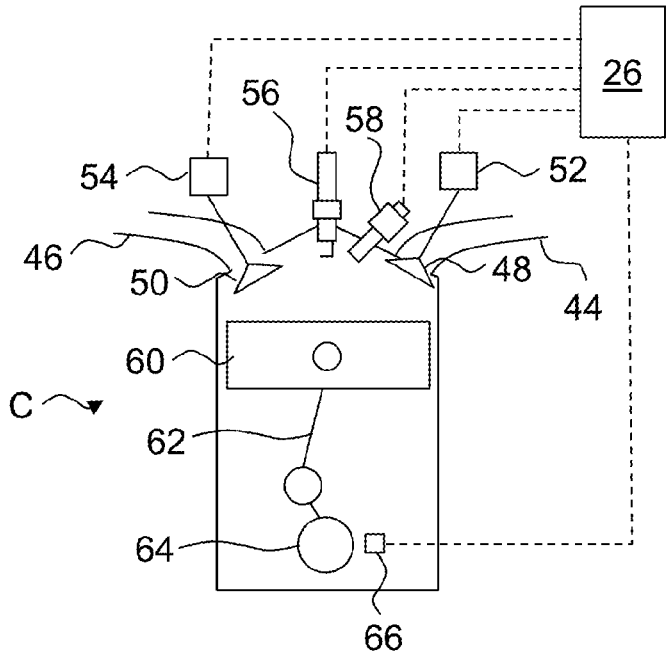
FIG. 2 is a schematic view of an exemplary combustion cylinder assembly of the engine of FIG. 1 and exemplary features of the variable displacement control system of FIG. 1.

FIG. 2 schematically illustrates exemplary features of the engine 18 and the cylinder deactivation assembly 28. The engine 18 can include a plurality of combustion cylinder assemblies arranged in the manner of exemplary combustion cylinder assembly C. The assembly C can include an intake port 44, exhaust port 46, intake valve 48, exhaust valve 50, intake actuator 52, exhaust actuator 54, spark plug 56, fuel injector 58, piston 60, connecting rod 62, and crankshaft 64. The intake actuator 52, exhaust actuator 54, spark plug 56, and fuel injector 58 can be features of the assembly C that can be shared with the cylinder deactivation assembly 28.

An engine speed sensor 66 can be configured to output data indicative of the rotational speed (Ne) of the crankshaft 64. This data can be expressed in revolutions per minute. The engine speed sensor 66 can be shared with other control systems of the engine 18, or the sensor 66 can be exclusive to the control system 24.

The controller 26 can be in electrical communication with the intake actuator 52, exhaust actuator 54, spark plug 56, fuel injector 58 and engine speed sensor 66. If the controller 26 determines that it can be advantageous to deactivate the combustion cylinder assembly C, the controller 26 can signal any appropriate one or combination of the intake actuator 52, exhaust actuator 54, spark plug 56 and fuel injector 58 to shut down. This shut down can prevent combustion of fuel within the assembly C, thereby increasing fuel efficiency of the engine 18 under certain operating conditions of the engine 18 and the vehicle 10.

The air temperature sensor 30 can be configured to output data indicative of a temperature of the ambient air (that is, air outside of the vehicle 10). Each wheel speed sensor 34LF, 34RF, 34LR, 34RR can be configured to output data indicative of a rotational velocity of a respective one of the plurality of wheels. The timer 32 can be configured to output clock data.

As shown in FIG. 1, the engine cooling system can include a radiator 36, a radiator inlet line 38, a radiator outlet line 40 and a coolant temperature sensor 42. The radiator 36 can be configured as an air-to-liquid heat exchanger. The radiator inlet line 38 can place the radiator 36 in fluid communication with hot engine coolant exiting the engine 18. The radiator outlet line 40 can place the engine 18 in fluid communication with engine coolant that has been cooled by the radiator 36. The coolant temperature sensor 42 can be configured to output data indicative of a temperature of the engine coolant flowing in the radiator outlet line 40.

The engine 18 can be connected to the vehicle 12 by at least one damper mount. The damper mount can be configured to attenuate an advantageous range of noise and vibrations generated by the engine 18 during its operation. This attenuation can be effective if the engine is operating with all or less than all of the combustion cylinder assemblies activated. However, certain ambient conditions can reduce the effectiveness of the damper mount(s) if the controller 26 deactivates one or more of the combustion cylinder assemblies. Accordingly, it can be advantageous to restrict deactivation of one or more of the combustion cylinder assemblies based on one or more ambient conditions.

II. Control Based on Engine Speed

Figure 3:
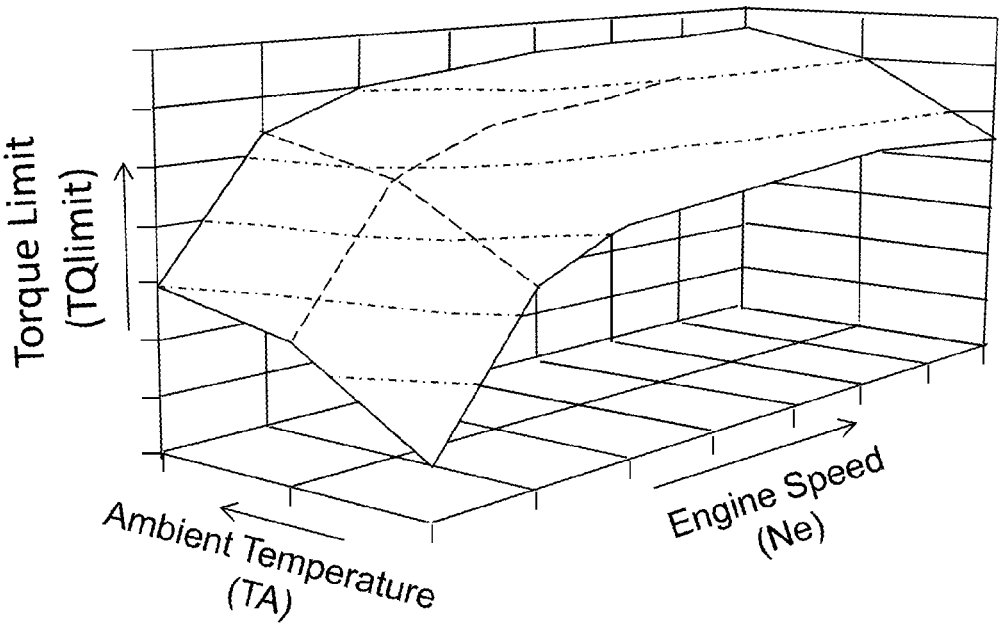
FIG. 3 is a graph of an exemplary torque limit plot in accordance with the disclosed subject matter.

FIG. 3 is a graph showing a three-dimensional torque limit plot for the engine 18 that is a function of engine speed and ambient temperature. This exemplary torque limit plot can decrease with decreasing ambient temperature and can reach a minimum value at a corresponding minimum ambient temperature value across each engine speed value. In other words, the exemplary torque limit plot of FIG. 3 can be advantageous if restriction on cylinder deactivation at cold ambient temperatures (for example, temperatures less than or substantially equal to 0° C.) is desirable. The torque limit plot of FIG. 3 can be predetermined to be advantageous for any one vehicle parameter of for any combination of vehicle parameters, such as but not limited to the intended number of activated and deactivated cylinders, the currently engaged one of the plurality of available gear ratios available in the transmission 20, the current vehicle speed, etc.

Figures 4, 5:
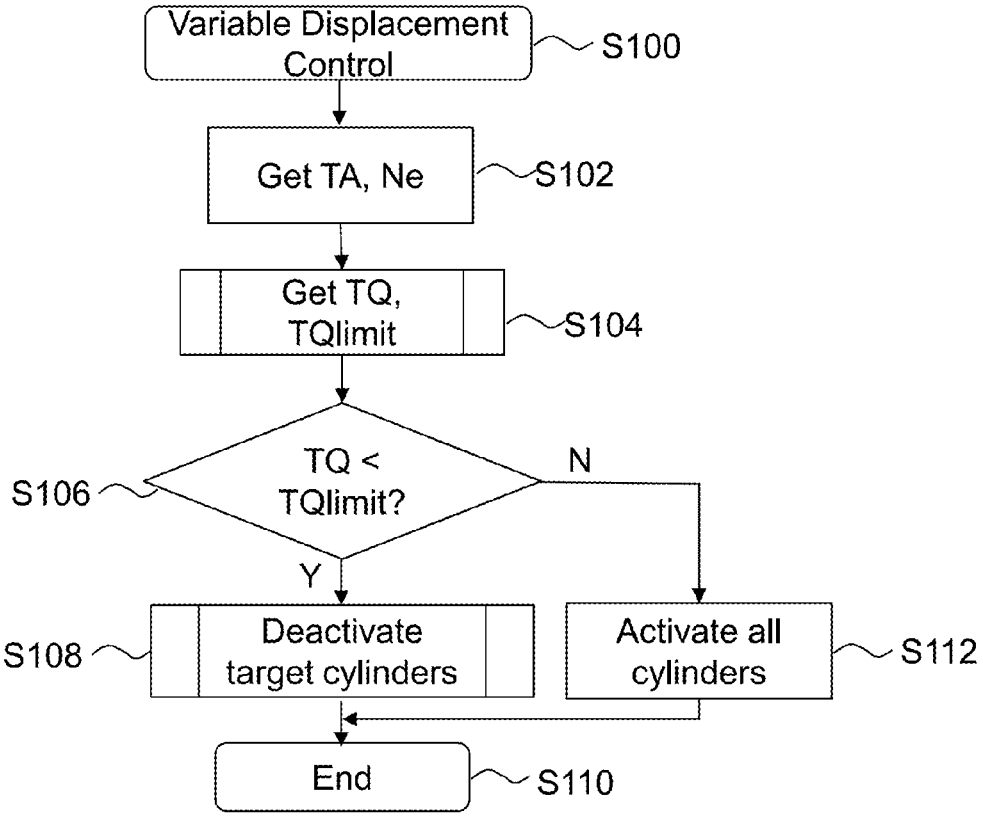
FIG. 4 is a flow chart of an exemplary algorithm in accordance with the disclosed subject matter.
FIG. 5 is an exemplary engine map in accordance with the disclosed subject matter.

FIG. 4 is a flowchart of an exemplary algorithm that the controller 26 can follow to selectively activate and deactivate one or more of the combustion cylinder assemblies of the engine 18. The controller 26 can begin the algorithm at step S100. The controller 26 can then proceed to step S102.

Figure 7:
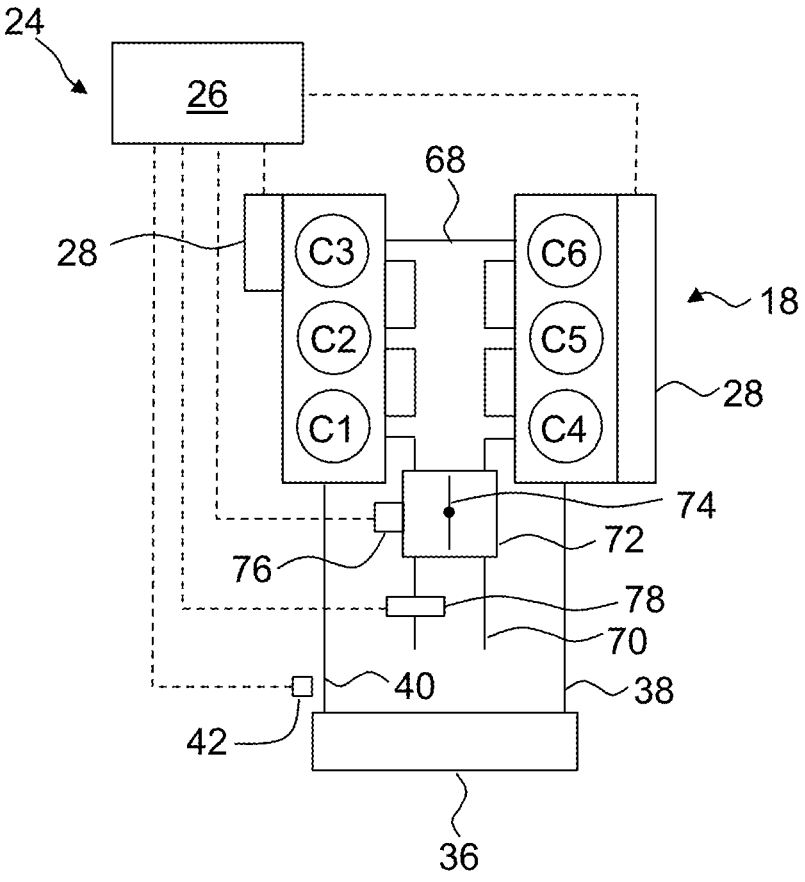
FIG. 7 is a schematic view of an internal combustion engine and a variable displacement control system in accordance with the disclosed subject matter.

At step S102, the controller 26 can obtain data from the air temperature sensor 30, data from the engine speed sensor 66, and data from a throttle position sensor (see, for example, exemplary sensor 76 of FIG. 7). The data from the air temperature sensor 30 can be indicative of the current ambient temperature (TA) of the ambient air outside of the vehicle 10. The data from the throttle position sensor can be indicative of the opening amount of the throttle valve expressed in a percentage of the wide open throttle position (WOT). The controller 26 can proceed to step S104.

At step S104, the controller 26 can obtain a value for the current engine torque (TQ) using the current values of the engine speed (Ne) and the throttle position (WOT). FIG. 5 is an exemplary engine map that the controller 26 can reference to determine the current value of torque (TQ) produced by the engine 18. The engine map can be stored in any appropriate electronic storage device integrated or in electrical communication with the controller 26. The engine map can include parameters such as engine speed (Ne) and throttle position (as a percentage of wide open throttle (WOT)) that can be used to obtain a corresponding value of the engine torque (TQ). However, exemplary embodiments are intended to include an engine map that includes any combination of appropriate parameters, such as but not limited to vehicle speed, engine load, air/fuel ratio, ignition timing, exhaust gas recirculation (EGR) mass fraction, etc., in order to obtain a value of the engine torque (TQ). The engine torque value can be any appropriate value such as but not limited to an estimated value that is based on predetermined data obtained during testing of the engine 18, an estimated value of the torque currently output by the engine 18 determined mathematically, an actual value of torque currently output by the engine 18 determined from real-time sensor data, an estimated value that can correspond to a target torque value desired by the vehicle operator where the desired target value can be based on sensor data generated by operator input(s), etc.

Also at step S104, the controller 26 can use the current values of the ambient temperature (TA) and the engine speed (Ne) to obtain the current value of the torque limit (TQlimit) from the torque limit plot of FIG. 3. The torque limit plot can be stored in any appropriate electronic storage device integrated or in electrical communication with the controller 26.

From step S104, the controller 26 can proceed to step S106. Here, the controller 26 can compare the current values of the engine torque (TQ) and the torque limit (TQlimit). If the controller 26 determines that the current value of the engine torque (TQ) is less than the current value of the torque limit (TQlimit), then the controller 26 can, at step S108, signal the cylinder deactivation assembly 28 to deactivate an appropriate number of the combustion cylinder assemblies. The controller 26 can proceed to step S110 where the controller 26 can exit the cylinder deactivation algorithm.

The controller 26 can be configured to follow any appropriate algorithm at step S108 that can deactivate an appropriate number of combustion cylinder assemblies in order to achieve an advantageous fuel efficiently target. By way of example only, at step S108, the controller 26 can follow one or more steps that can permit the controller 26 to consider vehicle parameters, such as but not limited to the current vehicle speed, the current engine load, the current engine torque, the current air/fuel ratio, the current gear ratio engaged in the transmission 20, etc. In this exemplary embodiment of step S108, the controller 26 can follow one or more steps in order to determine whether to deactivate a first subset of the cylinders of the engine 18 or to deactivate a second subset of cylinders of the engine 18, where the number of cylinders in the first subset is less than the number of cylinders in the second subset. However, exemplary embodiments are intended to include one or more steps at step S108 that can permit the controller 26 to deactivate only a fixed subset of cylinders or to deactivate any number of the cylinders that is less than the total number of cylinders of the engine 18.

If the controller 26 determines at step S106 that the engine torque (TQ) is greater than the current value of the torque limit (TQlimit), then the controller 26 can, at step S112, signal the cylinder deactivation assembly 28 to activate all of the combustion cylinder assemblies. From step S112, the controller 26 can proceed to step S110 where the controller 26 can exit the cylinder deactivation algorithm.

Thus, the control system 24 can selectively activate and deactivate one or more combustion cylinder assemblies of the engine 18 while minimizing or preventing the transmission of undesirable noise and vibration from the engine to the passenger compartment of the vehicle 10.

III. Control Based on Vehicle Speed

Figure 6:
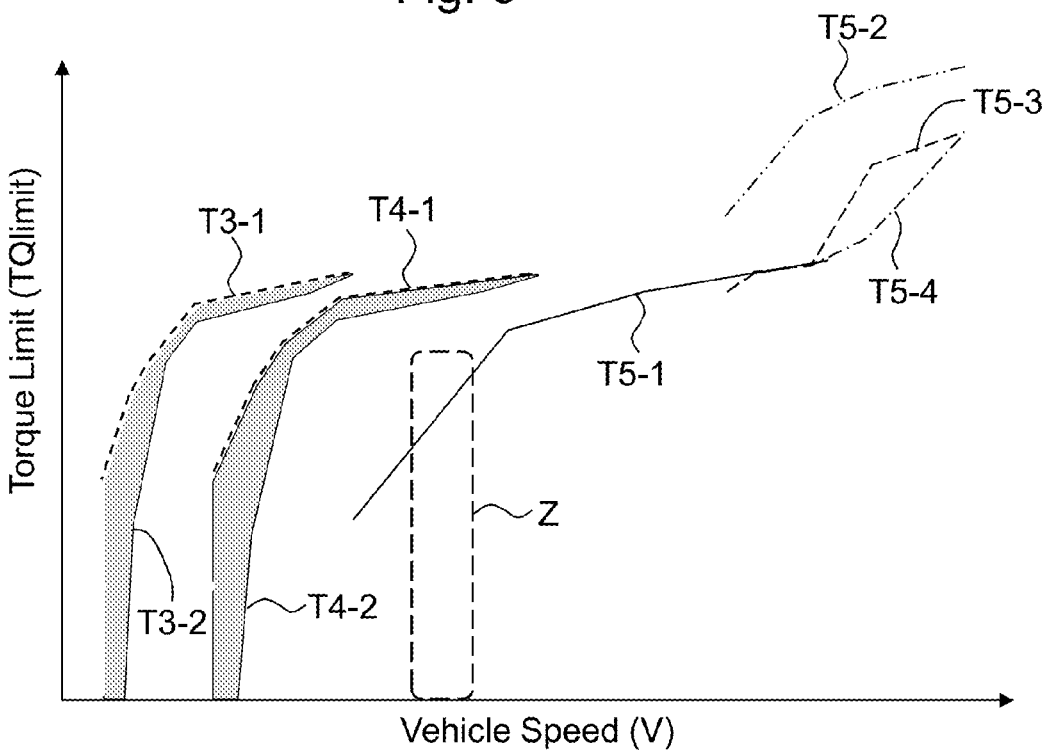
FIG. 6 is a graph showing a plurality of exemplary torque limit plots in accordance with the disclosed subject matter.

FIG. 6 is a graph of a plurality of torque limit plots T3-1, T3-2, T4-1, T4-2, T5-1, T5-2, T5-3, T5-4 that can be advantageous in enhancing or maximizing fuel efficiency over a plurality of vehicle operating parameters, and reducing or minimizing the transmission of undesirable engine noise and vibration to the passenger compartment of the vehicle 10. Instead of referencing the torque limit plot of FIG. 3 at step S104, the controller 26 can select a current value for the torque limit (TQlimit) from an appropriate one of the torque limit plots T3-1, T3-2, T4-1, T4-2, T5-1, T5-2, T5-3, T5-4 based on the current value of data obtained from a transmission speed sensor, such as but not limited to a sensor configured to output data indicative of the rotational speed of the output shaft of the transmission 20. The sensor or the controller 26 can be configured to translate the rotational speed into the vehicle speed (V) in any appropriate manner.

Exemplary embodiments are intended to include a controller 26 configured to obtain the current value of the vehicle speed (V) obtained from any combination of the wheel speed sensors 34LF, 34RF, 34LR, 34RR. The third torque limit plots T3-1, T3-2 can be advantageous if the third gear ratio is engaged in the transmission 20. The fourth torque limit plots T4-1, T4-2 can be advantageous if the fourth gear ratio is engaged in the transmission 20. The fifth torque limit plots T5-1, T5-2, T5-3, T5-4 can be advantageous if the fifth gear ratio is engaged in the transmission 20. However, exemplary embodiments are intended to include one or more torque limit plots for each of the possible gear ratios for the transmission 20.

The cold third torque limit plot T3-2 and the cold fourth toque limit plot T4-2 can be shifted to the right relative to the normal torque limit plot T3-1 and the normal fourth gear toque limit plot T4-1. The controller 26 can select the current value of the torque limit (TQlimit) from the normal torque limit plots T3-1 and T4-1 at step S104 of FIG. 3 if the current value for the ambient temperature (TA) is greater than or substantially equal to a predetermined threshold temperature. This predetermined threshold can delineate cold ambient conditions where deactivating one or more combustion cylinder assemblies can permit transmission of undesirable noise and vibrations from the engine 18 to the passenger compartment. The controller 26 can select the current value of the torque limit (TQlimit) from the cold plots T3-2 and T4-2 at step S104 of FIG. 4 if the ambient temperature (TA) is less than a predetermined threshold temperature. The predetermined threshold associated with the third torque limit plots T3-1, T3-2, can be the same as or different from the predetermined threshold associated with the fourth torque limit plots T4-1, T4-2.

The cold plots T3-2 and T4-2 can be shifted to right relative to the normal plots T3-1, T4-1 to reduce the opportunities for the controller 26 to deactivate one or more combustion cylinder assembly, as indicated by the respective shaded area between each of the normal third torque limit plot T3-1 and cold third torque limit plot T3-2 and between each of the normal fourth torque limit plot T4-1 and the cold fourth torque limit plot T4-2. This can advantageously reduce or minimize the transmission of noise and vibrations from the engine 18 to the passenger compartment during cold weather operation of the transmission 20 in the third or fourth gear ratios.

At step S104, the controller 26 can select the current value of the torque limit (TQlimit) from a normal fifth gear torque limit plot T5-1 if the current ambient temperature (TA) is greater than or substantially equal to a predetermined threshold. This predetermined threshold can be the same as or different from the predetermined threshold for any of the third or fourth gear torque limit plots T3-1, T3-2, T4-1, T4-2. The controller 26 can reference the normal fifth torque limit plot T5-1 if the vehicle 10 is traveling in a speed range of low to medium highway speeds.

The controller 26 can reference an appropriate one of an upper fifth torque limit plot T5-2, a medium fifth torque limit plot T5-3, and a lower fifth torque limit plot T5-4 if the vehicle 10 is traveling in of a speed range of medium to high highway speeds. At step S104, the controller 26 can select the current value of the torque limit (TQlimit) from the lower fifth torque limit plot T5-3 if the current ambient temperature (TA) is less than or substantially equal to a lower medium predetermined threshold. The lower predetermined threshold can be substantially the same or different from the predetermined threshold for any of the third torque limit plots T3-1, T3-2, the fourth torque limit plots T4-1, T4-2 and the normal upper fifth torque limit plot T5-1. At step S104, the controller 26 can select the current value of the torque limit (TQlimit) from the medium fifth torque limit plot T5-3 if the current ambient temperature (TA) is less than or substantially equal to a medium predetermined threshold and greater than the lower predetermined threshold. The medium predetermined threshold can be greater than the lower predetermined threshold. At step S104, the controller 26 can select the current value of the torque limit (TQlimit) from the upper fifth torque limit plot T5-2 if the current ambient temperature (TA) is less than or substantially equal to an upper predetermined threshold and greater than the medium predetermined threshold.

The upper, medium and lower predetermined thresholds can delineate various cold ambient conditions where deactivating one or more combustion cylinder assemblies can permit transmission of undesirable noise and vibrations from the engine 18 to the passenger compartment. This can advantageously reduce or minimize the transmission of noise and vibrations from the engine 18 to the passenger compartment during cold weather operation in the third or fourth gear ratios.

The third torque limit plots T3-1, T3-2 and the fourth torque limit plots T4-1, T4-2 can be advantageous if the controller 26 deactivates a particular subset of combustion cylinder assemblies. By way of example only, the third torque limit plots T3-1, T3-2 and the fourth torque limit plots T4-1, T4-2 can be advantageous if the controller 26 deactivates three cylinders of a six-cylinder engine 18.

The fifth torque limit plots T5-1, T5-2, T5-3, T5-4 can be advantageous if the controller 26 deactivates a particular subset of combustion cylinder assemblies. By way of example only, the fifth torque limit plots T5-1, T5-2, T5-3, T5-4 can be advantageous if the controller 26 deactivates two cylinders of a six-cylinder engine 18.

To further suppress the transmission of noise and vibration from the engine 18 to the passenger compartment of the vehicle 10, the controller 26 can be configured to modulate the lock-up clutch of the torque converter. By way of example only, if the fifth gear ratio of the transmission 20 is engaged and the vehicle speed (V) is within a predetermined range Z, then the controller 26 can be configured to modulate the lock-up clutch to allow an appropriate amount of slippage between the lock-up clutch and the torque converter. The predetermined range Z can delineate an exemplary zone of vehicle speed (V) and engine torque (TQ) in which this relative slippage can attenuate at least a portion of the noise and/or vibrations generated by the engine 18 if the controller deactivates one or more of the combustion cylinder assemblies.

Thus, the controller 26 can selectively activate and deactivate one or more combustions cylinders in order enhance or maximize fuel efficiency while simultaneously reducing or preventing the transmission of undesirable noise and/or vibrations from the engine 18 to the passenger compartment of the vehicle 10. Specifically, the controller 26 can monitor the ambient temperature (TA) in combination with at least one operating parameter of the vehicle 10 in order to determine an advantageous number of activated combustion chambers that can enhance or maximize fuel efficiency and enhance or maximize passenger comfort.

IV. Temperature Sensor(s)

In the exemplary embodiments described above, the controller 26 can be configured to receive data from a simple temperature sensor 30 exposed to the ambient air outside of the vehicle 10. The temperature sensor 30 can be a feature of the heating ventilation and cooling system for the passenger compartment of the vehicle 10. However, it can be advantageous for the controller 26 to access temperature data from a temperature sensor associated with an engine monitoring system. A temperature sensor associated with the engine monitoring system can be more durable, can be more accurate, can include an active fault detection apparatus and method, and can be more advantageous in engine diagnostics than a simple sensor such as the exemplary temperature sensor 30 of FIG. 1. Data from an air sensor 78, such as that illustrated in FIG. 7 and discussed in further detail below, can be used by other engine control systems such as but not limited to air/fuel mixture control, anti-knock control, etc. Thus, cost of the air sensor 78 can be amortized across multiple engine control systems. Implementation of the air sensor 78 into the control system 24 can be can be advantageous for any of these or other appropriate attributes.

FIG. 7 illustrates an exemplary arrangement of a temperature sensor configured for use in combination with at least one engine control and/or monitoring system in addition to the control system 24.

As shown in FIG. 7 the engine 18 can include a plurality of combustion cylinder assemblies C1, C2, C3, C4, C5, C6 arranged in two banks of three assemblies each. However, exemplary embodiments are intended to include any appropriate number and arrangement of the assemblies. Each of the assemblies C1, C2, C3, C4, C5, C6 can be configured in any appropriate manner such as but not limited to the configuration of the combustion cylinder assembly C of FIG. 2.

An intake manifold 68 can be in selective fluid communication with each of the cylinders C1, C2, C3, C4, C5, C6. An intake conduit 70 can be in fluid communication with the ambient air outside of the vehicle 10. A throttle assembly 72 can be connected between the intake manifold 68 and the intake conduit 70.

The throttle assembly 72 can include a movable throttle valve 74 and a throttle position sensor 76. The throttle valve 74 can be movably mounted to selectively open and close fluid communication between the intake conduit 70 and the intake manifold 68. The throttle position sensor 76 can be configured to output data indicative of the angular position of the throttle valve 74 that can be expressed as a percentage of the wide open throttle position (WOT). FIG. 7 shows the throttle valve 74 in the wide open throttle position.

The control system 24 can include an air sensor 78 extending into the intake conduit 70. The air sensor 78 can be configured to output data indicative of the mass flow rate and the temperature of the air passing through the intake conduit 70. Exemplary embodiments are intended to include a first air sensor that can be configured to output data indicative of the mass flow rate of the air passing through the intake conduit 70 and a second air sensor that can be configured to output data indicative of the temperature of the air passing through the intake conduit 70.

However, the air sensor 78 can be subject to heat transfer from other components/systems of the engine 18, the engine cooling system (such as but not limited to the radiator 36, radiator inlet line 38, radiator outlet line 40), relatively hot air trapped within the engine compartment of the vehicle 10, etc. For typical engine operations, this heat transfer might not adversely affect the data output by the sensor 78. However, under certain conditions this heat transfer can cause the data output from the sensor 78 to deviate from the current ambient temperature of the air outside of the vehicle 10.

V. Driving Cycle

Figure 8:
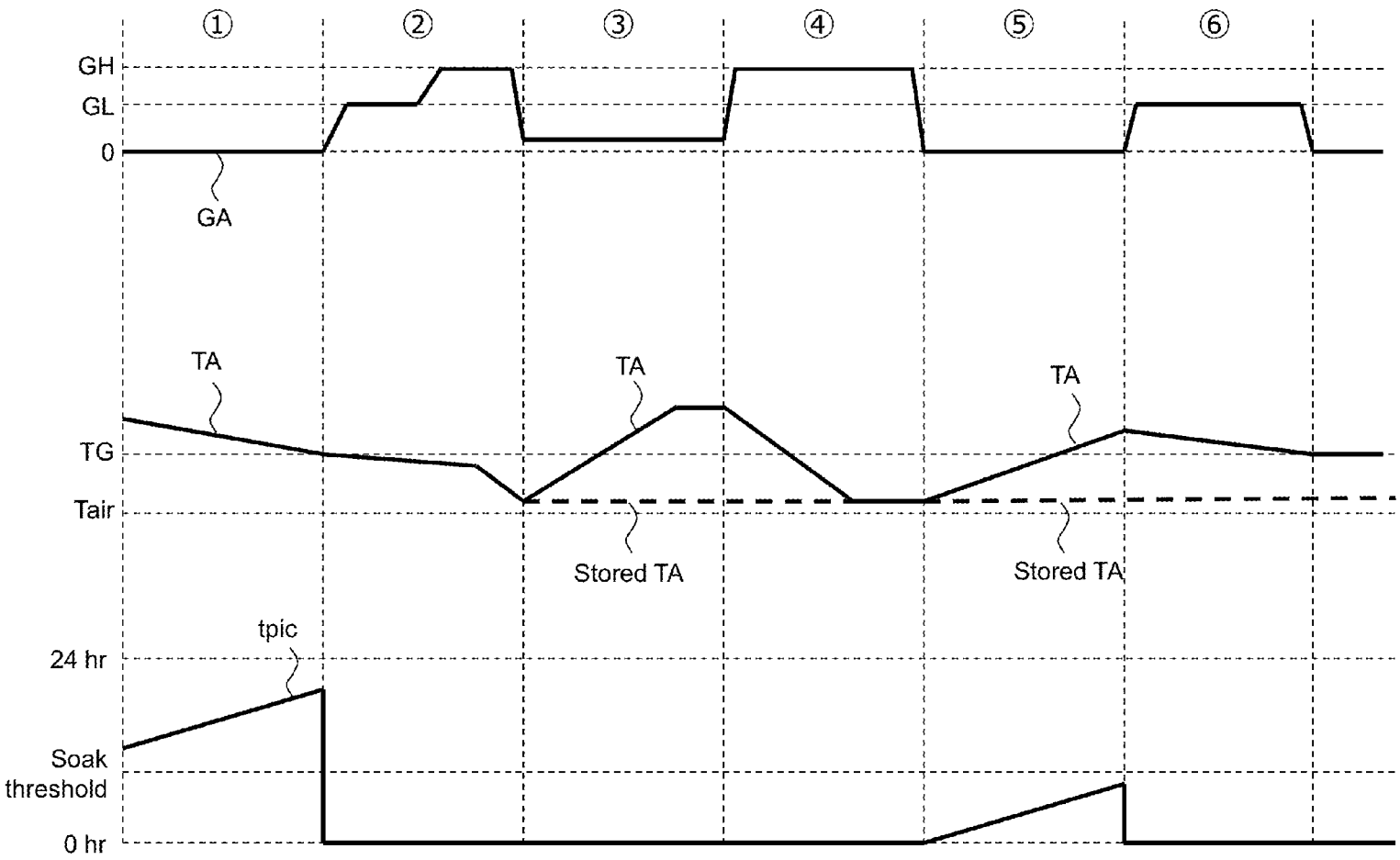
FIG. 8 is a graph showing exemplary plots of air mass flow rate, temperature and timer data in accordance with the disclosed subject matter.

FIG. 8 illustrates an exemplary driving cycle where the vehicle 10 is operated in at least one cold weather ambient condition. Region 1 can represent the end of cold weather driving cycle where the vehicle 10 is parked in a garage and the engine 18 is turned off. If power continues to be supplied to the air sensor 78, the data from the air sensor 78 can indicate that the measured value (TA) for the ambient temperature can exceed the ambient temperature (TG) of the garage and the ambient temperature (Tair) of the air outside the vehicle 10 and outside the garage. As the vehicle 10 continues to soak in the relatively cold ambient air of the garage, the data from the air sensor 78 can indicate that the measured ambient temperature (TA) continues to fall. If the vehicle 10 is left to soak in the relatively cold ambient environment of the garage for a sufficient time, then the data from the air sensor 78 can accurately reflect the actual ambient temperature (TG) of the air in the garage. This process can be referred to as a cold soak and occurs in the Region 1 of FIG. 8.

A cold soak threshold can be a predetermined elapsed time during which at least the air sensor 78 can be at a temperature substantially equal to the ambient temperature (TG) of the garage.

Region 2 of FIG. 8 can depict a new driving cycle that can begin after a cold soak. Region 2 shows exemplary plots of the measured ambient temperature (TA) and the measured air mass flow rate (GA) taken from exemplary data collected by the air sensor 78. In Region 2, the measured value of the air mass flow rate (GA) can increase from substantially zero to a low air mass flow rate (GL). After an elapsed period of time the mass flow rate can increase to a high air mass flow rate (GH). Also, the measured ambient temperature (TA) can decrease from the garage ambient temperature (TG) to the outside ambient temperature (Tair). If the engine 18 is operated at high air mass flow rate (GH), the measured ambient temperature (TA) can reach the actual ambient temperature (Tair). This can occur because the heat exchange rate from the engine 18 and/or the cooling system to the air sensor 78 can be minimized or eliminated due to cooling of the engine coolant in the radiator 36 and/or the due to the cooling of the air sensor 78 by the high flow ambient air.

Region 3 can represent an idle soak condition in which the engine speed (Ne) remains at an idle speed for an extended period of time such as might occur at a traffic light or during a traffic jam. In this region, the measured air mass flow rate (GA) can be less than the low air mass flow rate (GL) and the measured ambient temperature (TA) can increase above the actual ambient temperature (Tair).

Region 4 can represent a high flow condition where the measured air mass flow rate (GA) can be substantially equal to the high air mass flow rate (GH). Again, the measured value of ambient temperature (TA) can decrease and can approach the actual value of the ambient temperature (Tair).

Region 5 can represent a hot soak condition. A hot soak condition can occur after the engine 18 is shut off after the engine 18 has been operated for a sufficient time that the temperature of the coolant circulating through the radiator 36 can be greater than the actual ambient temperature (Tair). The latent heat from the engine 18 and the engine cooling system can be transferred to the air sensor 78. If power is supplied to the air sensor 78 during the hot soak condition, the data from the sensor 78 would show the measured ambient air temperature (TA) as increasing.

Region 6 can represent a low flow condition where the measured air mass flow rate (GA) can be substantially equal to the low air mass flow rate (GL). Again, the measured value of ambient temperature (TA) can decrease. However, the rate of decrease of the measured value of the ambient temperature (TA) might be so low as to prevent the measured value of the ambient temperature (TA) to reach the actual value of the ambient temperature (Tair).

VI. Potential Inaccuracies in Measured Ambient Temperature

Figure 9:
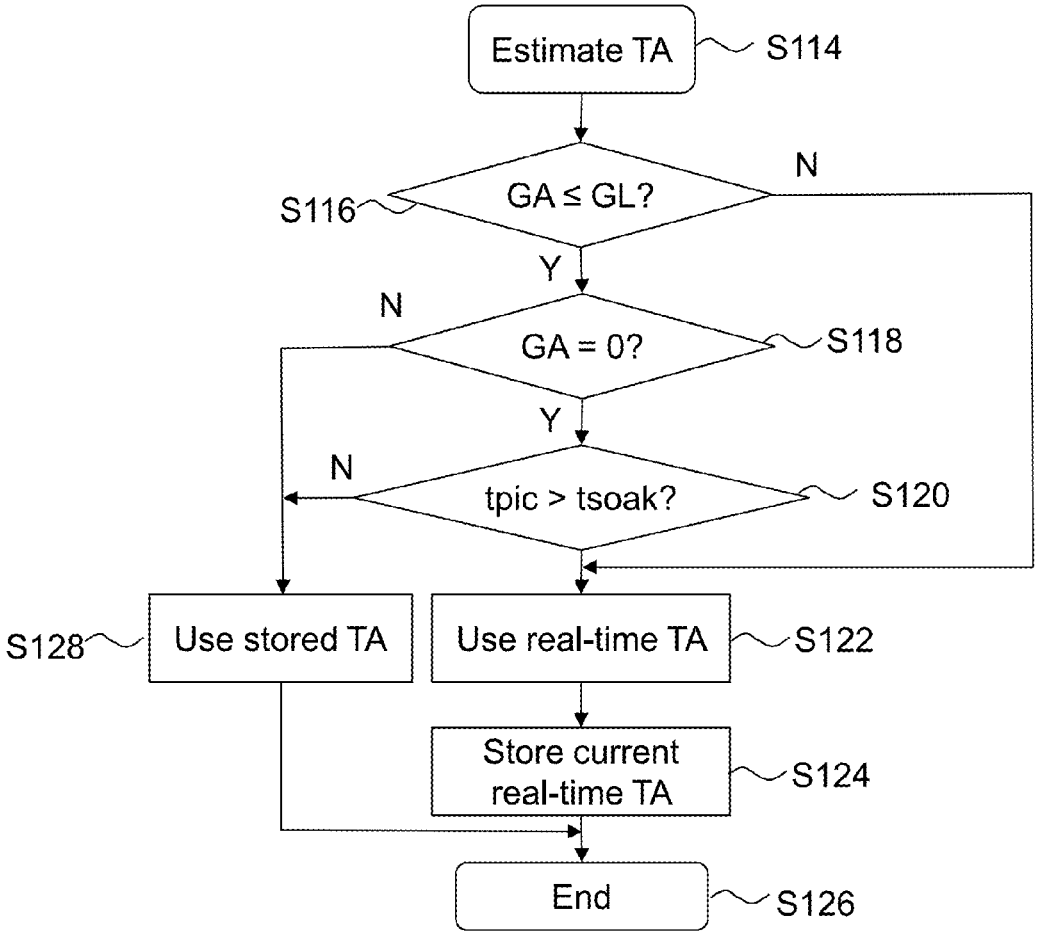
FIG. 9 is a flow chart of an exemplary subroutine in accordance with the disclosed subject matter and usable with the algorithm of FIG. 5.

In order to address or overcome these potential inaccuracies in the measured ambient temperature (TA), the controller 26 can be configured to follow an algorithm outlined by the flowchart of FIG. 9. The algorithm of FIG. 9 can permit the controller 26 to track measured ambient temperature if the vehicle 10 is subjected to one or more of the operating conditions discussed above with respect to FIG. 8. This tracking can permit the controller 26 to use replace a currently measured value for the ambient temperature (TA) with an estimated value that can advantageously approximate the current actual ambient temperature (Tair). The algorithm of FIG. 9 can be incorporated into the algorithm of FIG. 4, where the controller 26 can enter step S114 of FIG. 9 during step S102. The controller can then proceed to step S116.

During a cold soak condition, a hot soak condition, or an idle soak condition, the current value of the measured air mass flow rate (GA) can be less than or substantially equal to the low air mass flow rate (GL). Under any of these conditions, the data from the air sensor 78 might not accurately reflect the actual ambient air temperature (Tair), as exemplified in Regions 1, 3 and 5 of FIG. 8, respectively. However, if the current value of the measured air mass flow rate (GA) is greater than the low air mass flow rate (GL), then the vehicle 10 can be experiencing a high air mass consumption condition. Therefore, the data from the air sensor 78 can accurately reflect the actual ambient air temperature (Tair), as exemplified in Regions 2 and 4 of FIG. 8.

Thus, step S116 can be a first check that can determine the accuracy of the data from the air sensor 78. At step S116, the controller 26 can compare the current value of the measured air mass flow rate (GA) with the low air mass flow rate (GL). The low air mass flow rate (GL) can be a predetermined threshold of any appropriate value that can advantageously achieve the desired performance for the engine 18.

If the controller 26 determines that the current value of the measured air mass flow rate (GA) is greater than the low air mass flow rate (GL), then the controller 26 can proceed to step S122. If the controller 26 determines that the current value of the measured air mass flow rate (GA) is less than or substantially equal to the low air mass flow rate (GL), then the controller 26 can proceed to step S118.

During an idle soak condition or a hot soak condition, data from the air sensor 78 can show an increasing value for the measured ambient temperature (TA) or a value that can be greater than the actual ambient temperature (Tair). Region 3 of FIG. 8 illustrates an exemplary idle soak condition and Region 5 shows an exemplary hot soak condition. However, a cold soak condition of a sufficient duration can permit the current value of the measured ambient temperature (TA) to approach or to become substantially equal to the actual ambient temperature (Tair). If the current value of the measured air mass flow rate (GA) is not substantially equal to zero, then the vehicle 10 can be experiencing an idle soak condition. If the current value of the measured air mass flow rate (GA) is substantially equal to zero, then the vehicle 10 can be experiencing either a cold soak condition or a hot soak condition.

If the controller 26 determines at step S118 that the current value of the air mass flow rate (GA) is not substantially equal to zero, the controller 26 can proceed to step S128 If the controller 26 determines at step S118 that the current value of the air mass flow rate (GA) is substantially equal to zero, the controller 26 can proceed to step S120.

If the cold soak condition persists for an appropriate period of time, the vehicle 10 can be in thermal equilibrium with the ambient air outside of the vehicle 10. Thus, the data from the air sensor 78 can accurately reflect the actual ambient air temperature (Tair). A predetermined time threshold (tsoak) can be set at an appropriate value such that if the vehicle 10 is subjected to a cold soak condition for a time substantially equal to the time threshold (tsoak), then the vehicle 10 can be in thermal equilibrium with the ambient air outside of the vehicle 10.

At the start of a soak condition (i.e., the moment at which the measured air mass flow rate (GA) is substantially equal to zero), the controller 26 can initiate a soak timer (tpic). At step S120, the controller 26 can compare a value of the soak timer (tpic) with the time threshold (tsoak). If the controller 26 determines that the value of the soak timer (tpic) is less than or substantially equal to the time threshold, then the controller 26 can proceed to step S28. If the controller 26 determines that the value of the soak timer (tpic) is greater than the time threshold (tsoak), then the controller 26 can proceed to step S122.

If the value of the soak timer (tpic) is greater than the time threshold (tsoak) that it can be possible for the vehicle 10 to be in thermal equilibrium with the ambient air outside of the vehicle 10. Thus, the data from the air sensor 78 can accurately reflect the actual ambient temperature (Tair). At step S122, the controller 26 can obtain the current value of the measured ambient temperature (TA) using the current real-time signal from the air sensor 78. Then the controller 26 can proceed to step S124

At step S124, the controller 26 can store the current value of the measured ambient temperature (TA) in any appropriate electronic storage device. Since it can be likely that the current real-time data obtained from the air sensor 78 can accurately reflect the actual ambient temperature (Tair), the controller 26 can store the current value of the measured ambient temperature (TA) in any appropriate electronic storage device integrated or in electrical communication with the controller 26. The controller 26 can retrieve this stored value during a future iteration of the algorithm of FIG. 9 if the future value of the measured ambient temperature (TA) might be inaccurate. Further details of this operation are discussed below.

From step S124, the controller 26 can move to step S126 where the controller 26 can exit the algorithm of FIG. 9 and continue on to step S102 of the algorithm of FIG. 4.

Referring back to step S118, if the controller 26 determines that the current value of the measured air flow mass rate (GA) is not substantially equal to zero, the controller 26 can proceed to step S128. As discussed above, the current value of the measured air mass flow rate (GA) is less than the low air mass flow rate (GL) and not substantially equal to zero, then the vehicle 10 can be experiencing an idle soak. As shown in Region 3 of FIG. 8, the current value of the measured ambient temperature (TA) might not accurately reflect the actual ambient temperature (Tair). However, the value of the measured ambient temperature (TA) stored from a previous iteration of the algorithm of FIG. 9 can at least reasonably approximate the current actual ambient air temperature (Tair). Thus, at step S128, the controller 26 can retrieve the stored value of the measured ambient temperature (TA) for use in the algorithm of FIG. 4.

Referring back to step S120, if the controller 26 determines that the current value of the soak timer (tpic) is not greater than the time threshold (tsoak), the controller 26 can proceed to step S128. As discussed above, if current soak condition has not elapsed for a time period sufficient for the vehicle 10 to reach thermal equilibrium with the ambient air outside the vehicle 10, then the current value of the measured ambient temperature (TA) might not accurately reflect the actual ambient temperature (Tair). However, the value of the measured ambient temperature (TA) stored from a previous iteration of the algorithm of FIG. 9 can at least reasonably approximate the current actual ambient air temperature (Tair). Thus, at step S128, the controller 26 can retrieve the stored value of the measured ambient temperature (TA) for use in the algorithm of FIG. 4.

The value of the time threshold (tsoak) can be set at any appropriate value that can permit the vehicle to reach thermal equilibrium but not so large as to render the stored value of the measured ambient temperature (TA) inaccurate do to cyclic changes in the weather. In other words, it can be appropriate to consider a scenario where a value of the measured ambient temperature (TA) that was stored at midday might be retrieved in the early morning hours of the next day.

Referring back to step S116, if the controller 26 determines that the current value of the measured air mass flow rate (GA) greater than the low air mass flow rate (GL), then the vehicle 10 can be operating in a high air mass consumption condition. As shown in Regions 2 and 4 of FIG. 8, the current value of the measured ambient temperature (TA) can accurately reflect the actual ambient temperature (Tair) of the air outside of the vehicle 10. Thus, the controller 26 can proceed to steps S122, S124 and S126 as described above.

Thus, by monitoring certain engine parameters, such as air mass flow rate and soak times, the controller 26 can rely on data from the air sensor 78 to accurately reflect the actual temperature of the ambient air outside of the vehicle 10. Since the air sensor 78 can be a feature of other engine control and diagnostic systems, the air sensor 78 can provide advantageous sensor data reliably and with a minimum cost.

The controller 26 can be configured with hardware, with or without software, to perform the operations discussed above. Electrical communication lines (not numbered) can connect the controller 26 to the engine 18, the transmission 20, the cylinder deactivation assembly 28, the sensors 30, 34LF, 34RF, 34LR, 34RR, 42, 66, 76, 78 and the timer 32, in any appropriate manner. Electrical communication can be either one-way communication or two-way communication and can be networked or not networked. The controller 26 also can be referred to as an electronic control unit (ECU) or as a central processing unit. The sensors 30, 34LF, 34RF, 34LR, 34RR, 42, 66, 76, 78 can be configured with hardware, with or without software, to perform the assigned task(s).

Any of the sensors 30, 34LF, 34RF, 34LR, 34RR, 42, 66, 76, 78 can be configured as a smart sensor such that the sensor can process the raw data collected by the sensor prior to transmission to the controller 26 or the sensor can be configured as a simple sensor that passes the raw data directly to the controller 26 without any manipulation of the raw data. Any of the sensors 30, 34LF, 34RF, 34LR, 34RR, 42, 66, 76, 78 can be configured to send data to the controller 26, with or without a prompt from the controller 26.

The wheel speed sensors 34LF, 34RF, 34LR, 34RR can be mounted on an appropriate portion of the vehicle 10 to detect rotation of the respective wheel 14L, 14R, 16L, 16R (or the respective driveshaft 22L, 22R) in any appropriate manner. The raw data from the wheel speed sensors 34LF, 34RF, 34LR, 34RR can be processed by one or both of the wheel speed sensors 34LF, 34RF, 34LR, 34RR or by the controller 26 to indicate a rotational velocity of the respective wheels 14L, 14R, 16L, 16R. The wheel speed sensors 34LF, 34RF, 34LR, 34RR can be any type of sensor capable of providing the appropriate data.

Exemplary embodiments are intended to include the timer 32 integrated into the controller 26. Exemplary embodiments are intended to include the controller 26 configured with hardware, with or without software, to perform the function provided by the timer 32 of the exemplary embodiment described above.

VII. Alternative Embodiments

While certain embodiments of the invention are described above, and FIGS. 1-9 disclose the best mode for practicing the various inventive aspects, it should be understood that the invention can be embodied and configured in many different ways without departing from the spirit and scope of the invention.

Embodiments are disclosed above in the context of automotive vehicles. However, embodiments are intended to be applicable to any type of vehicle, including boats, ships, aircraft, etc.

Embodiments disclosed above disclose the fuel injector 58 arranged in a direct-injection configuration. However, embodiments are intended to include any fuel supply configuration such as but not limited to a port fuel-injection configuration, a single fuel injector that can supply each of the cylinder assemblies, a plurality of fuel injectors associated with each cylinder assembly, at least one carburetor, etc.

The disclosed controllers and other apparatus can include processors and computer programs implemented by processors used to perform various of the operations and determinations disclosed above. Exemplary embodiments are intended to cover all software or computer programs capable of enabling processors to implement the above operations and determinations. Exemplary embodiments are also intended to cover any and all currently known, related art or later developed non-transitory recording or storage mediums (such as a CD-ROM, DVD-ROM, hard drive, RAM, ROM, floppy disc, magnetic tape cassette, etc.) that record or store such software or computer programs. Exemplary embodiments are further intended to cover such software, computer programs, systems and/or processes provided through any other currently known, related art, or later developed medium (such as transitory mediums, carrier waves, etc.), usable for implementing the exemplary operations disclosed above.

These computer programs can be executed in many exemplary ways, such as an application that is resident in the memory of a device or as a hosted application that is being executed on a server and communicating with the device application or browser via a number of standard protocols, such as TCP/IP, HTTP, XML, SOAP, REST, JSON and other sufficient protocols. The disclosed computer programs can be written in exemplary programming languages that execute from memory on the device or from a hosted server, such as BASIC, COBOL, C, C++, Java, Pascal, or scripting languages such as JavaScript, Python, Ruby, PHP, Perl or other sufficient programming languages.

Some of the disclosed embodiments include or otherwise involve data transfer over a network, such as communicating various inputs over the network. The network may include, for example, one or more of the Internet, Wide Area Networks (WANs), Local Area Networks (LANs), analog or digital wired and wireless telephone networks (e.g., a PSTN, Integrated Services Digital Network (ISDN), a cellular network, and Digital Subscriber Line (xDSL)), radio, television, cable, satellite, and/or any other delivery or tunneling mechanism for carrying data. Network may include multiple networks or subnetworks, each of which may include, for example, a wired or wireless data pathway. The network may include a circuit-switched voice network, a packet-switched data network, or any other network able to carry electronic communications. For example, the network may include networks based on the Internet protocol (IP) or asynchronous transfer mode (ATM), and may support voice using, for example, VoIP, Voice-over-ATM, or other comparable protocols used for voice data communications. In one implementation, the network includes a cellular telephone network configured to enable exchange of text or SMS messages.

Examples of a network include, but are not limited to, a personal area network (PAN), a storage area network (SAN), a home area network (HAN), a campus area network (CAN), a local area network (LAN), a wide area network (WAN), a metropolitan area network (MAN), a virtual private network (VPN), an enterprise private network (EPN), Internet, a global area network (GAN), and so forth.

While the subject matter has been described in detail with reference to exemplary embodiments thereof, it will be apparent to one skilled in the art that various changes can be made, and equivalents employed, without departing from the scope of the invention. All related art references discussed in the above Description of the Related Art section are hereby incorporated by reference in their entirety.

What is claimed is:

1. A variable displacement controller for use with a vehicular engine that includes multiple cylinder assemblies, the controller including a processor for performing various operations, comprising:

receiving data indicative of ambient temperature;

receiving data indicative of at least one of engine speed and vehicle speed;

determining an engine torque value based on the received data indicative of engine speed;

determining a normal torque limit based on the data indicative of vehicle speed if the ambient temperature is greater than or substantially equal to a predetermined threshold temperature;

determining a cold torque limit based on the data indicative of vehicle speed if the ambient temperature is less than the predetermined threshold temperature, wherein a vehicle speed associated with a given torque limit value of the cold torque limit is greater than a vehicle speed associated with the given torque limit value of the normal torque limit;

comparing the determined engine torque value to the determined torque limit; and selectively activating/deactivating at least one of the engine cylinder assemblies based on the comparison between the engine torque value and the torque limit, such that the at least one of the engine cylinder assemblies is deactivated if the engine torque value is less than the torque limit, and the at least one of the engine cylinder assemblies is activated if the engine torque value is greater than or equal to the torque limit.

2. The variable displacement controller of claim 1, wherein the engine includes at least one of an intake actuator, exhaust actuator, spark plug, and fuel injector, and the processor selectively deactivates the at least one of the engine cylinder assemblies by sending a control signal to shut down at least one of the intake actuator, exhaust actuator, spark plug, and fuel injector to thereby prevent combustion within the at least one of the engine cylinder assemblies.

3. The variable displacement controller of claim 1, wherein the processor receives data indicative of ambient temperature outside of the vehicle from an air temperature sensor, and determines temperature of ambient air outside of the vehicle based on that data.

4. The variable displacement controller of claim 1, wherein the processor receives data indicative of engine speed from an engine speed sensor and from a throttle position sensor, and determines an engine torque value based on the data received from the engine speed sensor and from the throttle position sensor.

5. The variable displacement controller of claim 4, wherein the processor determines the engine torque value utilizing at least one electronically stored engine map that includes at least one parameter, the at least one parameter including any one of engine speed, throttle position as a percentage of wide open throttle, ignition timing, and exhaust gas recirculation mass.

6. The variable displacement controller of claim 1, wherein the processor determines a torque limit using an electronically stored torque limit plot of engine speed versus ambient temperature.

7. The variable displacement controller of claim 1, wherein the processor receives data indicative of vehicle speed from a transmission speed sensor that is configured to output data indicative of the rotational speed of a vehicular transmission output shaft, and the processor determines a torque limit using at least one torque limit plot that is based on the data received from the transmission speed sensor.

8. The variable displacement controller of claim 7, wherein the at least one torque limit plot includes three separate torque limit plots, a first of the torque limit plots being selected if a transmission third gear ratio is engaged, a second of the torque limit plots being selected if a transmission fourth gear ratio is engaged, and a third of the torque limit plots being selected if a transmission fifth gear ratio is engaged.

9. The variable displacement controller of claim 8, wherein the processor shifts at least one of the first and second torque limit plots if the ambient temperature is greater than or equal to the predetermined threshold temperature.

10. The variable displacement controller of claim 9, wherein processor selects a current value from the third torque limit plot if the transmission fifth gear ratio is selected and the ambient temperature is greater than or equal to a second predetermined threshold temperature.

11. A variable displacement system, comprising:

a vehicle engine including multiple cylinder assemblies;

a temperature sensor that obtains data indicative of ambient air temperature;

a speed sensor that obtains data indicative of at least one of engine speed and vehicle speed; and a variable displacement controller that includes a processor for performing at least the following operations:

receiving the data indicative of ambient temperature and the data indicative of at least one of engine speed and vehicle speed;

selecting one of a current ambient temperature and a previous ambient temperature based on at least one thermal soak condition;

determining an engine torque value based on the received data indicative of engine speed;

determining a torque limit based on the selected one of the current ambient temperature and the previous ambient temperature, and on the data indicative of vehicle speed;

comparing the determined engine torque value to the determined torque limit; and selectively activating/deactivating at least one of the engine cylinder assemblies based on the comparison between the engine torque value and the torque limit, such that the at least one of the engine cylinder assemblies is deactivated if the engine torque value is less than the torque limit, and the at least one of the engine cylinder assemblies is activated if the engine torque value is greater than or equal to the torque limit.

12. The variable displacement system of claim 11, further comprising at least one of an intake actuator, exhaust actuator, spark plug, and fuel injector, and the processor selectively deactivates the at least one of the engine cylinder assemblies by sending a control signal to shut down at least one of the intake actuator, exhaust actuator, spark plug, and fuel injector to thereby prevent combustion within the at least one of the engine cylinder assemblies.

13. The variable displacement system of claim 11, wherein the temperature sensor is disposed to obtain data indicative of ambient temperature outside of the vehicle, and the processor determines temperature of ambient air outside of the vehicle based on that data.

14. The variable displacement system of claim 11, wherein the processor receives data indicative of engine speed from the speed sensor and from a throttle position sensor, and determines an engine torque value based on the data received from the speed sensor and from the throttle position sensor.

15. The variable displacement system of claim 14, wherein the processor determines the engine torque value utilizing an electronically stored engine map that includes parameters including engine speed and throttle position as a percentage of wide open throttle.

16. The variable displacement system of claim 11, wherein the processor determines a torque limit using an electronically stored torque limit plot of engine speed versus ambient temperature.

17. The variable displacement system of claim 11, wherein the speed sensor is a transmission speed sensor that is configured to output data indicative of the rotational speed of a vehicular transmission output shaft, and the processor determines a torque limit using at least one torque limit plot that is based on the data received from the transmission speed sensor.

18. The variable displacement system of claim 17, wherein the at least one torque limit plot includes three separate torque limit plots, a first of the torque limit plots being selected if a transmission third gear ratio is engaged, a second of the torque limit plots being selected if a transmission fourth gear ratio is engaged, and a third of the torque limit plots being selected if a transmission fifth gear ratio is engaged.

19. The variable displacement system of claim 18, wherein the processor shifts at least one of the first and second torque limit plots if the ambient temperature is greater than or equal to a predetermined threshold temperature, and the processor selects a current value from the third torque limit plot if the transmission fifth gear ratio is selected and the ambient temperature is greater than or equal to a second predetermined threshold temperature.

20. A method of performing variable displacement for a vehicular engine that includes multiple cylinder assemblies, the method comprising:

receiving data indicative of ambient temperature;

receiving data indicative of at least one of engine speed and vehicle speed;

determining an engine torque value based on the received data indicative of engine speed;

selecting one of a current ambient temperature and a previous ambient temperature based on at least one thermal soak condition;

determining a torque limit based on the selected one of the current ambient temperature and the previous ambient temperature, and at least one of the data indicative of the engine speed and the data indicative of vehicle speed;

comparing the determined engine torque value to the determined torque limit; and selectively activating/deactivating at least one of the engine cylinder assemblies based on the comparison between the engine torque value and the torque limit, such that the at least one of the engine cylinder assemblies is deactivated if the engine torque value is less than the torque limit, and the at least one of the engine cylinder assemblies is activated if the engine torque value is greater than or equal to the torque limit.

* * * * *